United States Patent [19]

Bischoff, Jr.

[11] 4,063,580

[45] Dec. 20, 1977

[54] MECHANISM FOR HOLDING FASTENERS

[76] Inventor: Robert F. Bischoff, Jr., 30 Fairmount Ave., Morristown, N.J. 07960

[21] Appl. No.: 656,856

[22] Filed: Feb. 10, 1976

[51] Int. Cl.[2] ..... B25B 15/00

[52] U.S. Cl. ..... 145/51

[58] Field of Search ..... 145/51, 50 F

[56] References Cited

U.S. PATENT DOCUMENTS

| | | | |
|---|---|---|---|
| 486,395 | 11/1892 | Carr | 145/51 |
| 797,078 | 8/1905 | Shelton | 145/50 F |
| 1,126,370 | 1/1915 | Borresen | 145/51 |
| 1,645,753 | 10/1927 | Hanson | 145/51 X |
| 2,570,230 | 10/1951 | Hammond | 145/51 X |
| 2,671,484 | 3/1954 | Clark | 145/51 |
| 2,698,637 | 1/1955 | Donovan | 145/51 |
| 3,396,765 | 8/1968 | Ridenour | 145/51 X |
| 3,604,488 | 9/1971 | Wishart | 145/51 |

FOREIGN PATENT DOCUMENTS

| | | | |
|---|---|---|---|
| 509,728 | 11/1920 | France | 145/51 |
| 2,020,904 | 11/1971 | Germany | 145/51 |
| 904,356 | 8/1962 | United Kingdom | 145/52 |

*Primary Examiner*—James L. Jones, Jr.
*Assistant Examiner*—J. T. Zatarga

[57] ABSTRACT

A mechanism which holds a fastener's head in a non-slipping position and in which the shaft of the said mechanism is the driving force which rotates the said fastener in either a counterclockwise or a clockwise direction.

In the field of mechanics, when screwing a screw into wood or other types of material, the screw driver being used for the said screwing has a tendency to slip from the screw-head of the screw being screwed, either slipping to one side or to the other. It then usually becomes the chore of the workman governing the driving or screwing to keep control over the holding of the said screw driver in proper contact with the head of the screw, and at the same time, the said workman must keep control of the upright position of the said screw with the material into which the screw is to be inserted.

2 Claims, 13 Drawing Figures

MECHANISM FOR HOLDING FASTENERS

The basis of this invention is that it is a mechanism which is adaptable to a multiple of driving instruments and fasteners, since this invented mechanism may have modifications to its shaft at either or both of its ends. Accordingly, in this specification, the driving instrument and the fastener to be driven are described, but the changing of the shaft at either or both ends is understood to be determined at the time of manufacture of the said mechanism, or the said mechanism can be constructed with interchangeable parts.

In addition, this invention has the principal function of holding screws, flat or round heads particularly, though this invented mechanism is adaptable to other fasteners, since the fastener head holding element of the mechanism can be of various structures, which said structures are adaptable to the engagement of said various structured fasteners so that proper functioning occurs, that is, that the rotation of the said shaft in either a clockwise or a counterclockwise direction forces the said structured fastener to be twisted or contorted into the proper position so that ejection of the fastener to the materials into which the said fastener is to be embedded occurs. Thereby this invented mechanism causes the fastener to be properly directed into the materials, and the mechanism also holds the head of the fastener so that the said invented mechanism does not slip to the side, which said slipping is a problem when pressing a fastener into materials where a forward force is pertinent for the said fastener to be efficiently inserted.

IN THE DRAWINGS:

FIG. 1 depicts the invented mechanism in a fully relaxed position. FIG. 2 shows the position of the said mechanism in a partly recessed position, said position being caused by the position of the said mechanism over a fastener (24).

FIG. 3 shows the position of the invented mechanism in a fully recessed position, which said position occurs by manually holding the mechanism in this position. This said position is used for aligning the fastener with the shaft, and this fully recessed position is necessary in order to put the lower pins (21) into the shaft (7).

Figure 1:
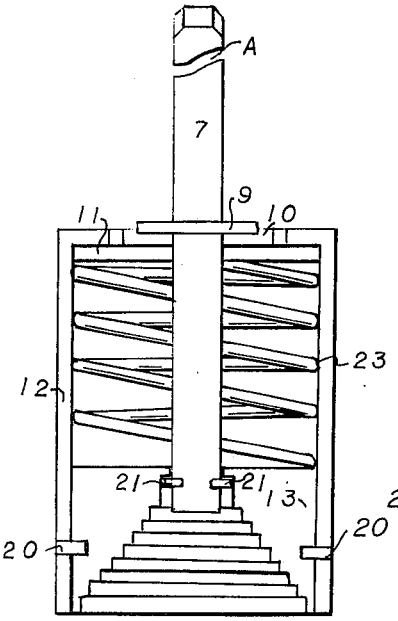
FIG. 1 is a cross-sectional side view of the mechanism taken through A—A of FIG. 6.
Figure 2:
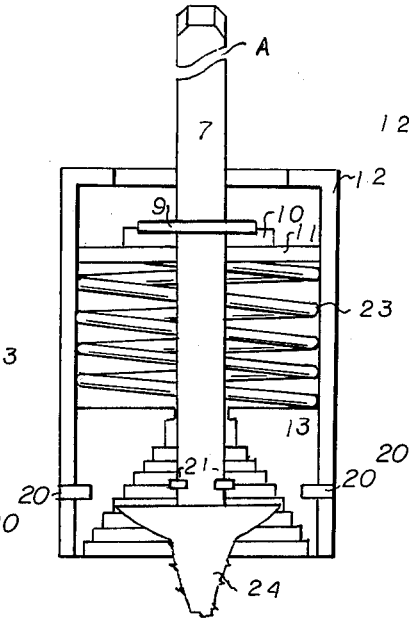
FIG. 2 is a cross-sectional side view of the invented mechanism in a partly recessed position.
Figure 3:
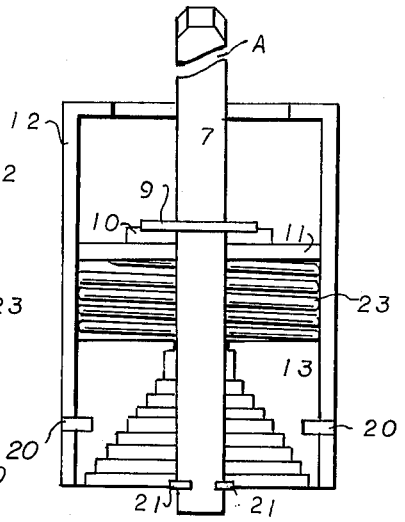
FIG. 3 is a cross-sectional side view of the mechanism in a fully recessed position.
Figure 4:
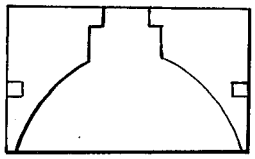
FIG. 4 is a cross-sectional side view of the guide with an interior arched wall.
Figure 9:
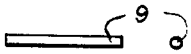
FIG. 9 shows a side view and a top view of the plate pin.
Figure 10:
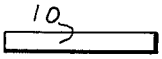
FIG. 10 shows a side view and a top view of the rotating plate.

The type guide (13) used in FIGS. 1–3 is the guide used when the fastener being used contains a flat head; whereas, FIG. 4 shows a modification to this said guide, which said modification to the guide is used when the invented mechanism is adapted to be used with round head fasteners.

The construction of this invented mechanism is such that it is developed so that parts of the mechanism can be interchangeable. One example of this interchangeable development is when the pins (20) which hold the guide (13) in place in the cylinder housing (12) are constructed so that they possess threaded means to allow for said pins (20) to be screwed in and out of both types of the said guide, thereby making the said guides interchangeable.

Figure 5:
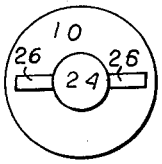
FIG. 5 is a bottom view of the intended mechanism.
Figure 5:
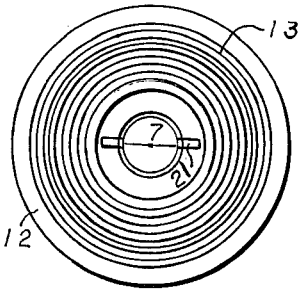

FIG. 5 shows a bottom view of the invented mechanism. The multiple surfaces are to correspond to the separate holding of various fasteners.

The guide depicted in FIGS. 1–3 is the type which is adapted to flathead fasteners. A modification of this type guide can be made by having the edges of the stepping ledges in the said guide rounded slightly, which rounding will permit this flathead guide to be adapted to work also in relation to roundhead fasteners. However, though the said rounded off type guide can be used for roundhead fasteners, the type guide shown in FIG. 4 for use with roundhead fasteners comprises a fuller area of contact with the said roundhead fasteners.

The surfaces in the stepped guide as shown in FIGS. 1–3 indicate particular sizes and proportions relative to corresponding parts and areas; however, these drawings and this specification do not govern sizes and proportions used with the invented mechanism, but rather the selection of the desired sizes and the amount of variation in the sizes which can be used in the mechanism should be at the discretion of the manufacturer of the invented mechanism.

The various surface areas that the steps in the guide shown in FIGS. 1–3 and in FIG. 5 depict, can be of a precise measurement corresponding to the standard of fasteners, in either the metric or the linear systems. When manufacturing this invented mechanism, it can be constructed so that the mechanism's guide has several differently sized guides which are interchangeable, or it can be manufactured so that there are different mechanisms with various sized guides because of the wide selection of sizes of fasteners.

Figure 6:
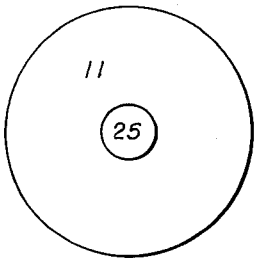
FIG. 6 is a top view of the invented mechanism.
Figure 6:
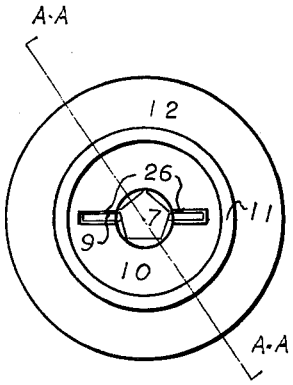

FIG. 6 is a top view of the invented mechanism. The shaft (7) as shown, is a pentagon, and is illustrated in the drawing to be adapted to a ratchet type driver, though as shown in FIGS. 1–3 and in FIG. 7, Area A, a different type end can be adapted for this shaft to permit other types of driving force than a ratchet type to be used with this invented mechanism.

In FIG. 6, the rotating plate(10) is the upper plate of the shaft, and this said plate(10) has grooves(26) for the seating of the plate pin(9), which said seating causes an engagement between the said plate(10) and the said pin(9). This engagement is for the shaft's(7) rotation in either direction, so that the plate(10) rides over the spring holding plate(11). This riding of the plates is for the best efficiency of the invented mechanism.

Figure 7:
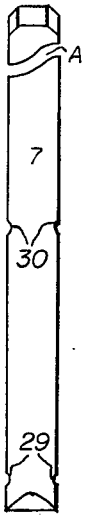
FIG. 7 is a perspective side view of the shaft.
Figure 11:
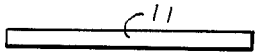
FIG. 11 shows a side view and a top view of the spring holding plate.

FIG. 7 depicts the shaft(7) with holes(30) for the insertion of pin(9), and holes(29) for the insertion of pin(21). The pin(21)-Figures 1–3 of the shaft(7) can be of the type described for pins(20)-Figures 1–3 for interchangeable development. FIG. 3 shows the mechanism in a position where the pin(21) is accessible to be removed, thus permitting interchanging of the shaft(7).

In addition, the entire shaft's diameter can be constructed smaller, and this shaft with a smaller diameter can be inserted into the invented mechamism. But for this change to be made, a new guide with a smaller hole to replace guide(13), and new plates to replace plates(-Figures 1–3, 10, 11) with smaller center holes in the said plates than the holes depicted in FIGS. 10 and 11, 24 and 25, respectively, must also be used to keep the shaft with the smaller diameter properly aligned.

Figure 8:
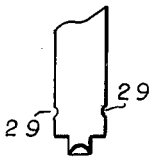
FIG. 8 is a perspective side view of a modified end of the shaft.

FIG. 8 shows the end of the shaft which goes into contact with the fastener. This end of the shaft has been modified in the area which engages the fastener. The said modification consists of having the end constructed so that it is adaptable to smaller fasteners. This said modified end of the shaft shows holes(29) into which pin(21) is inserted.

Figure 12:
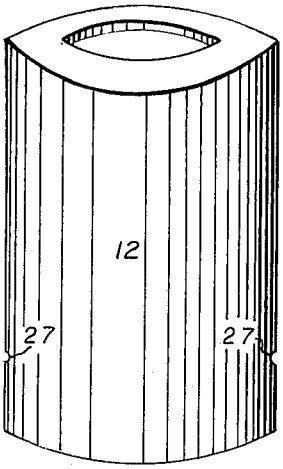
FIG. 12 is a perspective view of the cylinder housing of the invented mechanism.

The cylinder housing(12), FIG. 12, has a cylinder wall which said wall ends on the bottom, but said wall forms a right angle on its top, then proceeds for a short distance as depicted in FIG. 12 and FIGS. 1–3. This upper or top section of the cylinder wall is for the purpose of holding plate(11) so that it does not eject further up than intended due to pressure from the spring (FIGS. 1–3, 23), and also the said top section stabilizes the mechanism. The holes in the cylinder housing(27) are for the insertion of pins(20).

Figure 13:
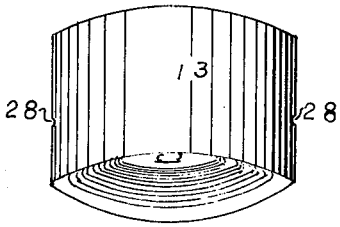
FIG. 13 is a perspective view of the guide.

FIG. 13 depicts the guide(13). The holes(28) are for insertion of pins(20). In the construction of the guide, it is possible to skip every other step. However, with a step eliminated, the next step in the guide would be used for the smaller fastener, which said fastener might be somewhat loose. It has been found, however, that the ensuing "play" can be tolerated by the invented mechanism, so that the said play does not affect the proper functioning of the mechanism since the slight movement of the guide from one side to the other on top of the fastener will not cause the said guide to fall off the head of the fastener since the movement or play will not be great enough to cause the disengagement of the mechanism and the fastener. The steps used, and the steps eliminated, therefore, will be at the determination of the manufacturer.

It is to be understood that when using this invented mechanism, when the said mechanism is placed over a fastener, the mechanism, or more particularly, the guide, should be wiggled slightly to be sure that the said fastener has slipped into its appropriate step and is not caught on the preceding step. Then the pressure from the spring in the mechanism will force the guide to a downward direction against the fastener head, with the allowance of the force being exerted by the manual gripping of the mechanism; therefore, the mechanism will be an environment to the fastener that will keep the fastener in a position for ultimate efficiency.

Though this application illustrates a particular type fastener, it should be understood that a bolt type or other type fastener is able to be used because of the adaptability of this invented mechanism.

It is within the scope of this application that elements which comprise the invented mechanism, such as the guide and the shaft, can be used alone or in conjunction with a tool.

It is also within the scope of this application that though the illustration exhibits a particular type fastener, it should be understood that this type invented mechanism, with modifications, is applicable to other projections.

Although but a single embodiment of my invention has been illustrated and described herein, it is apparent that various changes and alterations may be made therein by those skilled in the art without departing from the spirit of the invention. Accordingly, I do not desire to be limited to the specific details of the precise embodiment disclosed by way of example; rather the scope of the invention is as defined in the appended claim.

I claim:

1. A simplified mechanism for driving a fastener into applicable material, said mechanism comprising a removable shaft having a fastener driving end with removable transverse abutment pin means adjacent the driver end and a removable transverse plate pin spaced from said pin means away from said driver end; a housing means coaxially positioned on said shaft and surrounding said driver end, said housing means having an open bottom, a top wall with an opening smaller than said open bottom through which said shaft extends, and a surrounding wall between said top and open bottom; a removable, solid, one-piece guide member in said housing adjacent the open bottom held therein by removable guide pins in said surrounding wall, said guide member being coaxial with said shaft and having an internally stepped arrangement for accommodating the heads of differently sized fasteners, the stepped arrangement being defined by a plurality of spaced, circumferential, parallel steps of decreasing diameter in the direction away from said open bottom, and the circumferential step farthest from the open bottom being above and having a diameter smaller than the length of said transverse abutment pin means for abutting therewith; a coaxial return spring in said housing surrounding said shaft above said guide member abutting thereagainst at one end; two coaxial plates surrounding said shaft above said spring, the two plates in rotational friction contact with each other, the lower plate abutting the spring on one side and providing stop means on the other side with the housing means top wall, and the upper plate abutting the transverse plate pin, whereby when the head of a fastener is positioned on one of the circumvential steps, the driver end may be urged against the action of the spring into engagement with the head for driving same, after which the return spring will return the housing means to a rest position with the transverse abutment pin means abutting the farthest circumferential step.

2. The driving mechanism as in claim 1, wherein the upper plate is removable and has on its upper surface abutting the transverse plate pin, a transverse groove for accommodating the transverse plate pin.

* * * * *